United States Patent [19]

Rohr et al.

[11] Patent Number: 5,029,541

[45] Date of Patent: Jul. 9, 1991

[54] DEVICE FOR THE FORMATION AND SEWING OF A HEM AT AN OPENING IN A WORKPIECE

[75] Inventors: Gunter Rohr, Hemmingen; Wolfgang Norz, Schwieberdingen, both of Fed. Rep. of Germany

[73] Assignee: Union Special GmbH, Stuttgart, Fed. Rep. of Germany

[21] Appl. No.: 355,988

[22] Filed: May 23, 1989

[30] Foreign Application Priority Data

May 31, 1988 [DE] Fed. Rep. of Germany ..... 3818450

[51] Int. Cl.[5] ..... D05B 21/00; F16H 7/08

[52] U.S. Cl. ..... 112/121.26; 112/121.15; 474/109

[58] Field of Search ..... 112/10, 63, 121.12, 112/121.15, 121.26, 254, 262.2, 305, 121.27, 141, 143, 148, 152, 153, 303; 474/109, 110

[56] References Cited

U.S. PATENT DOCUMENTS

| | | | |
|---|---|---|---|
| 3,786,768 | 1/1974 | Kosrow et al. | 112/143 |
| 3,865,058 | 2/1975 | Rovin et al. | 112/10 X |
| 4,046,087 | 9/1977 | Manetti | 112/121.15 |
| 4,098,201 | 7/1978 | Adamski, Jr. et al. | 112/121.15 X |
| 4,185,570 | 1/1980 | Kleinschmidt et al. | 112/121.26 |
| 4,284,192 | 8/1981 | Taylor | 474/109 X |
| 4,473,017 | 9/1984 | Letard et al. | 112/121.26 X |
| 4,475,474 | 10/1984 | von Hagen et al. | 112/121.26 |
| 4,478,595 | 10/1984 | Hayakawa et al. | 474/109 |
| 4,512,268 | 4/1985 | Rohr | 474/110 X |
| 4,590,874 | 5/1986 | Baclagis | 112/121.26 |
| 4,602,579 | 7/1986 | Pollmeier et al. | 112/121.26 |
| 4,665,848 | 5/1987 | Michaels et al. | 112/121.26 |

*Primary Examiner*—Werner H. Schroeder
*Assistant Examiner*—Paul C. Lewis
*Attorney, Agent, or Firm*—Morgan & Finnegan

[57] ABSTRACT

A device for the automatic formation and sewing of a hem at a continuous edge of an opening of variable width in a workpiece, a hem-forming device on a sewing machine which is controlled by a logic device. An actual force acting upon a guide body is compared with at least one desired force preselectably stored in the logic device. In the event of a difference between these forces, an adjusting device actuates the guide body, serving as a cloth tensioner, until an actual force corresponding to the desired force is established on the guide body.

15 Claims, 3 Drawing Sheets

DEVICE FOR THE FORMATION AND SEWING OF A HEM AT AN OPENING IN A WORKPIECE

BACKGROUND OF THE INVENTION

The invention relates to a device for the automatic formation and sewing of a hem at an endless edge of an opening of variable width in a workpiece, having hem-forming means on a sewing machine controlled by a logic device.

In the patent specification DE 27 45 868 C3, a plurality of rollers and two freely rotatable cloth carrier cages are provided for receiving the workpiece, the edges of which rollers and cages are disposed at a distance in front of the edge of a cloth carrier plate. Two rollers, which are movable upwardly and downwardly, serve as cloth tensioners, and switches for sensing the size of the workpiece are associated with the rollers. The large number of parts required results in a complicated, and hence, expensive construction. The minimum width of the openings in the workpieces is disadvantageously limited owing to the fact that it is necessary for the workpiece to embrace the cloth carrier cages and the tensioning rollers.

SUMMARY OF THE PRESENT INVENTION

A principal feature of the present invention is the provision of a device for the automatic formation and sewing of a hem at an endless edge of a workpiece.

The device of the invention forms and sews the hem at a continuous edge of an opening of various widths in a workpiece, by a hem-forming means on a sewing machine which is controlled by a logic device, and which has at least one needle which is movable and penetrates a needle plate. The device comprises a guide body which is partially embraced by the workpiece, so as to serve as a cloth tensioner and which is disposed at a distance from the needle plate and is movable upwardly and downwardly. The device has a logic device which compares an actual force, detected by an actual value transducer, acting upon the guide body and thereby upon the edge of the workpiece, with at least one desired, preselectable force, such that in the event of a difference between the desired force and the actual force, the distance of the guide body from the cloth-supporting plate is variable by an adjusting means in such a way that a force corresponding to the preselected desired force is transmissible to the edge of the workpiece by way of the guide body.

Thus, a feature of the invention is that hems at openings of small width, such as waist and leg openings in bathing trunks, are formed with constant and/or variable prestress of the workpiece corresponding to the opening in the workpiece in an automatic manner and in accordance with at least one desired value.

Yet another feature of the invention is that by using a actual value transducer, which signals the logic device the actual force acting upon the guide body and the edge of the workpiece, the logic device compares the signaled value with at least one desired value, and an adjusting means may be actuated in such a way that the desired force can be transmitted to the edge of the workpiece by way of the guide body.

Still another feature of the invention is that by providing a suitable control panel by which a desired force can be selected, simple variation of the at least one desired force may be performed by the operator of the sewing machine.

Further features will become more fully apparent in the following description of the embodiments of this invention and from the appended claims.

DESCRIPTION OF THE PREFERRED EMBODIMENTS

Figure 1:
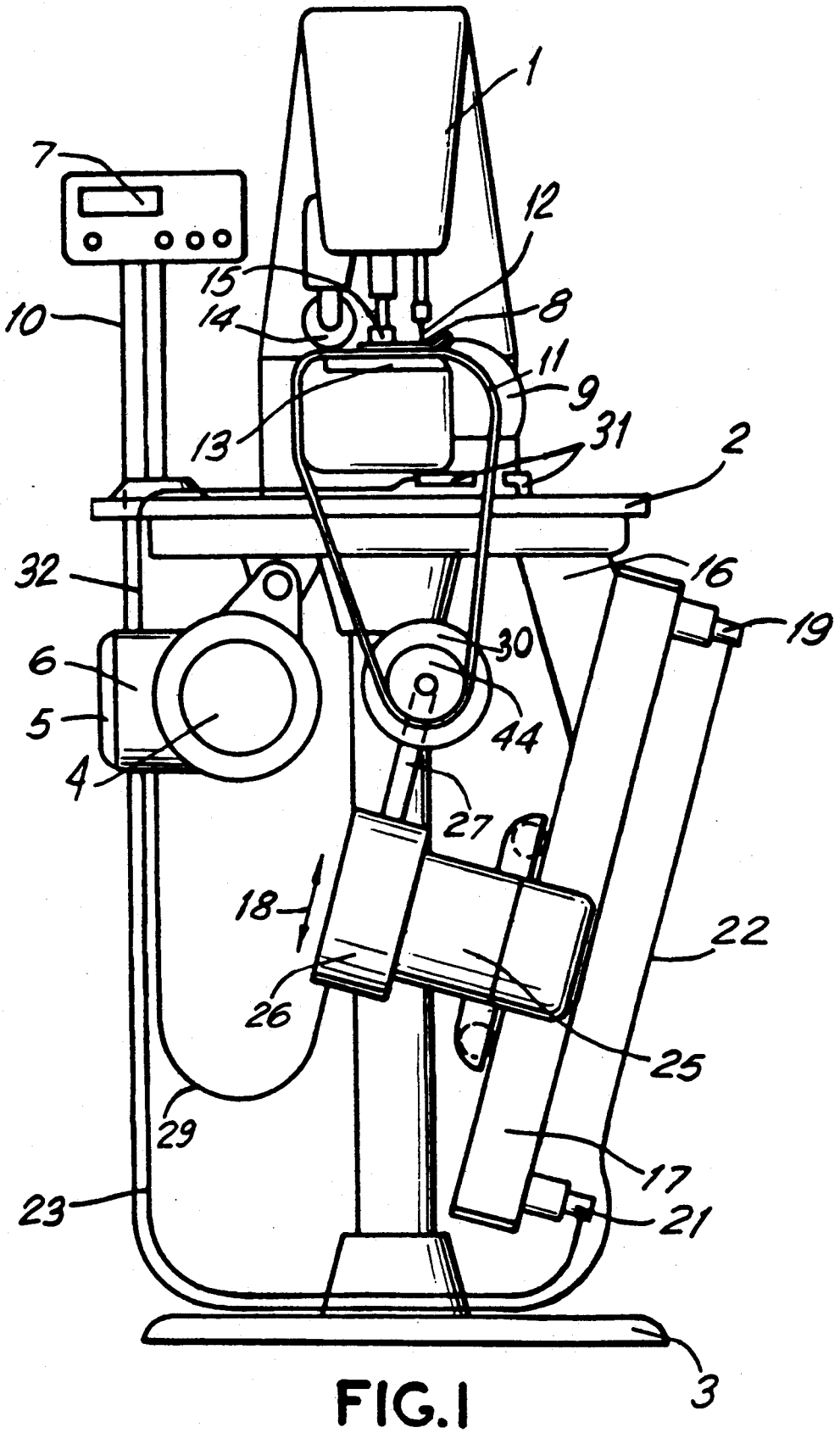
FIG. 1 is an elevational view showing a sewing machine fitted with a device for the formation and sewing of a hem at the edge of an opening in a workpiece, as viewed from an operating side of the sewing machine.

Referring to FIG. 1, a sewing machine 1 is mounted in a conventional manner on a table top 2 which is carried by a stand 3. A drive motor 4 for the sewing machine 1 is suspended from the table top 2 and has a logic device 5 which includes a computer or central processing unit 6. Furthermore, the table top 2 carries a control panel 7 which renders it possible to vary one or a plurality of desired forces stored in the computer 6 and which is connected to the computer 6 by way of a lead 10. A hem-forming means 9 for a continuous (endless) edge of a workpiece 11, such as a conventional folder for turning over the edge, is located in front of the sewing location 8 of the sewing machine 1.

The sewing machine 1 has a needle 12 which is movable upwardly and downwardly and which thereby penetrates a needle plate 13. A puller roller 14, disposed beyond a presser device 15, serves additionally to assist the workpiece feed of the sewing machine 1. A holder 16 secured to the stand 3 carries a double-acting pressure medium cylinder 17 whose movement indicated by a double arrow 18 is controlled by the computer 6 by means of a solenoid valve 19 and a solenoid valve 21 by way of electrical leads 22 and 23. A mounting plate 25 is disposed so as to be movable upwardly and downwardly on the pressure medium cylinder 17 which is subjected to pressure medium through pressure medium lines and which performs the function of an adjusting means. The mounting plate 25 carries an actual value sensor which acts as a travel sensor 33 (FIGS. 2 and 3) and which is in the form of a known incremental transducer 26 in which a coded plate senses a plurality of sensor elements and thereby evaluates the movement of a spring-loaded pin 27 and signals the said movement to the computer 6 by way of a lead 29. The free end of the pin 27 carries a guide body which is partially embraced by the workpiece 11 and which is in the form of a wheel 44 and includes a disc 30.

A sensor 31, connected to the computer 6 by way of a lead 32, senses the leading end of the sewn hem approaching the needle 12, the sensor 31 reacting to, for example, the difference in thickness between the sewn and unsewn hem.

Figure 2:
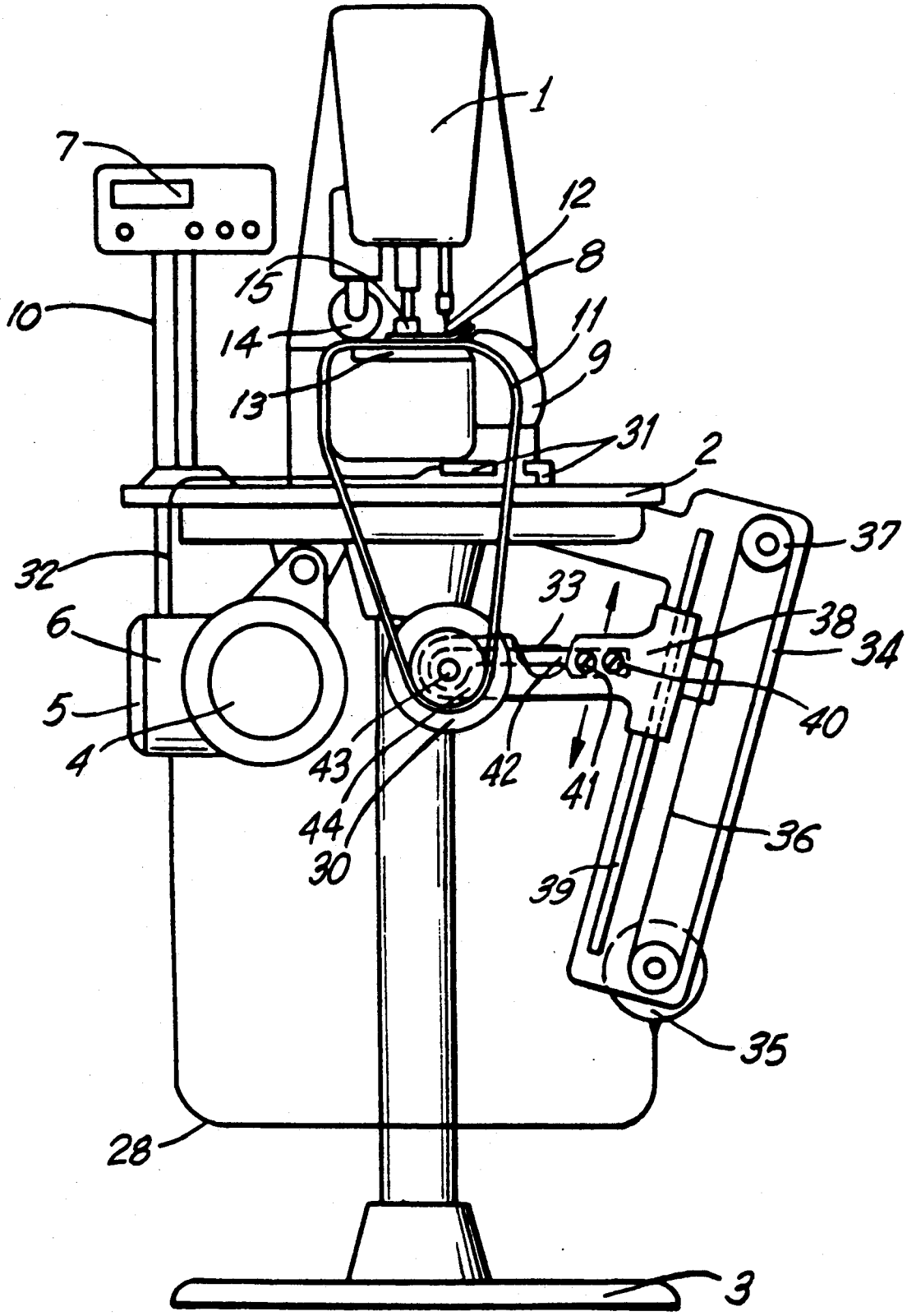
FIG. 2 is an elevational view showing a sewing machine fitted with another embodiment of a device for the formation and sewing of a hem at the edge of an opening in a workpiece, viewed from the operating side of the sewing machine.
Figure 3:
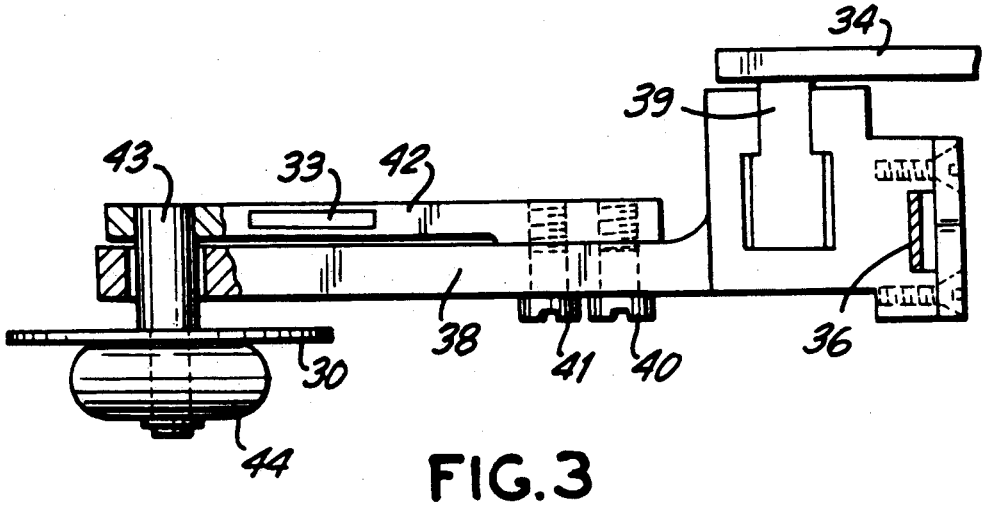
FIG. 3 is a fragmentary plan view, taken partly in section, showing a guide body and an actual value sensor.

In FIG. 2, in contrast to the device shown in FIG. 1, the actual value sensor is a travel sensor 33 in the form of a known strain gauge strip which is connected to the computer 6 by way of an electronic evaluation means. A stepping motor 35 serving as an adjusting means is secured to a holder 34 secured to the support 3 and is controlled by the computer 6 by way of a lead 28. A plate 38 is moved upwardly and downwardly by means of a toothed belt 36 and a guide pulley 37 which is also disposed on the holder 34. The plate 38 is rigidly connected to the toothed belt 36 and is guided by means of a rail 39.

A flexible arm 42 is rigidly connected to the plate 38 by means of a screw 40 and screw 41, and carries the travel sensor 33 in the form of a gauge strain strip. A stud 43 is disposed at the free end of the arm 42 and extends through the plate 38 and carries the disc 30 and the freely rotatably mounted wheel 44, which is ball-shaped.

Figure 4:
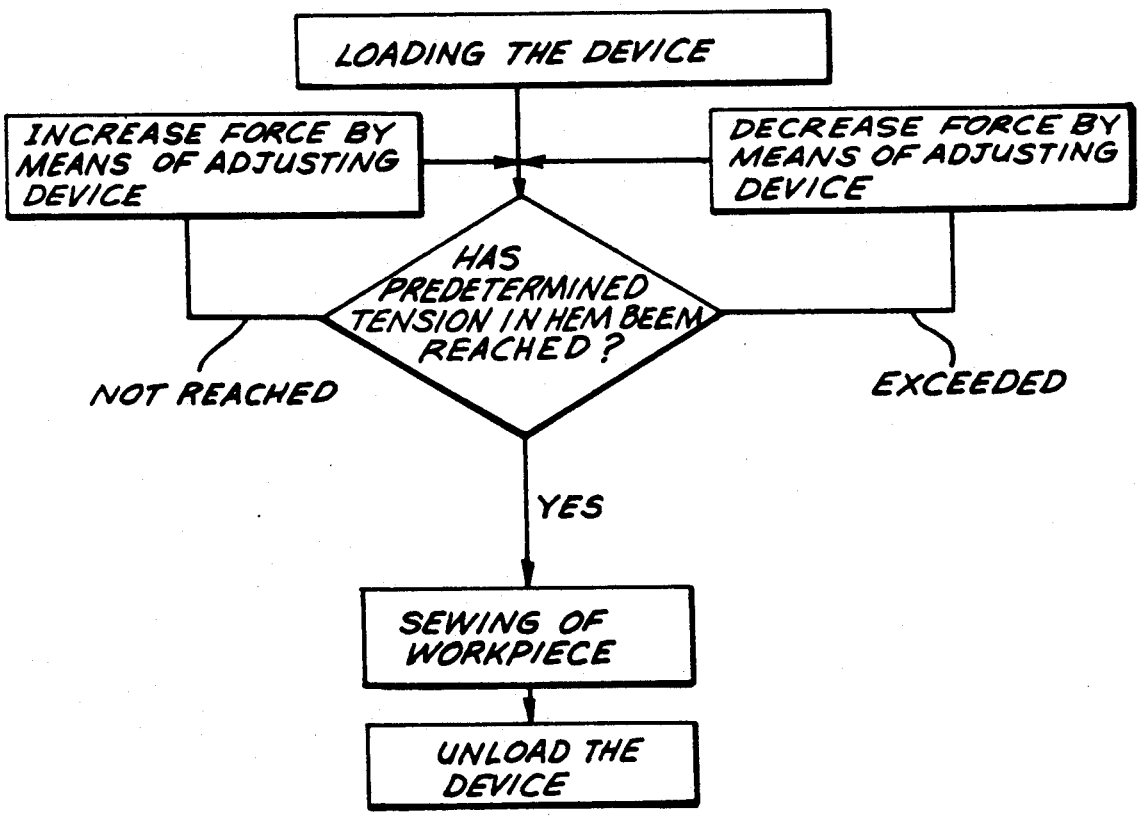
FIG. 4 is a logic diagram of the operation of the device.

FIG. 4 is a logic diagram in which the mode of operation of the actual value and desired value comparison is shown diagrammatically. The sewing operation is initiated only after the prescribed, desired value or the desired tension of the hem has been attained on the workpiece 11.

The mode of operation of the device will be described hereinafter.

A workpiece is tensioned in a known manner over the guide body 30 and 44, and is introduced into the hem-forming means 9. The actual value sensor detects the tension or the actual force present in the workpiece and signals it to the computer 6 which compares it with at least one preselectably stored desired value. In the event of a difference between the desired value and the actual value, the adjusting means is actuated and biases the guide body to a greater or lesser extent until the desired pre-tension of the opening in the workpiece is obtained. Hence, it is ensured that the same pre-tension always exists, even in the case of openings of different size in the workpiece 11 which can occur as a result of, for example, manufacturing tolerances. As a result of the preselectable desired values, it is also possible, in the case of, for example, bathing trunks, to subject the left leg opening to a different pre-tension from that of the right portion of the same size, in order to compensate for differences in the feed of the workpiece at the leg portions. Furthermore, the body or waist opening of the bathing trunks can be subjected to a third pre-tension, since the various desired values can also be called up from the computer 6 in synchronism. The actual sewing operation is initiated in a known manner after the desired force has been reached. The presser device 15 is lowered and the sewing machine 1 commences the sewing operation. The sensor 31 in front of the needle 12 detects the hem already sewn, and the sewing operation is terminated after a preselectable number of stitches, the sewing threads are cut and the presser device 15 is raised.

A further opening in the workpiece, or a fresh workpiece can then be sewn. By virtue of the comparison between the desired value and the actual value of the pre-tension of the workpiece directly at each opening in the workpiece, a uniform and high quality of seam is obtained and is not dependent upon the concentration exercised by the operator.

The foregoing detailed description is given for clearness of understanding only, and no unnecessary limitations should be understood therefrom, as modifications will be obvious to those skilled in the art.

What is claimed is:

1. A device for the automatic formation and sewing of a hem at a continuous edge of an opening of various widths in a workpiece, comprising hem-forming means on a sewing machine controlled by a logic device, said hem forming means having at least one needle movable and penetrating a needle plate, a guide body partially embraced by the workpiece, so as to serve as a cloth tensioner and is disposed at a distance from the needle plate and is movable upwardly and downwardly, the logic device comparing an actual force, detected by an actual value transducer, acting upon the guide body and thereby upon the edge of the workpiece, with at least one preselectable desired force from a range of forces, whereby, in the event of a difference between the desired force and the actual force, the distance of the guide body from a cloth-supporting plate is variable by an adjusting means in response to feedback from said logic device in such a way that a force corresponding to the preselected desired force is transmissible to the edge of the workpiece by way of the guide body.

2. A device as claimed in claim 1, wherein the actual value transducer comprises a travel sensor, a prescribed force being associated with an effective length detected at the travel transducer.

3. A device as claimed in claim 1, wherein the guide body comprises a freely rotatably mounted wheel of spherical construction.

4. A device for the automatic formation and sewing of a hem at a continuous edge of an opening of various widths in a workpiece, comprising hem-forming means on a sewing machine controlled by a logic device, said hem forming means having at least one needle movable and penetrating a needle plate, a guide body partially embraced by the workpiece, so as to serve as a cloth tensioner and is disposed at a distance from the needle plate and is movable upwardly and downwardly, the logic device comparing a actual force, detected by an actual value transducer, acting upon the guide body and thereby upon the edge of the workpiece, with at least one preselectable desired force from a range of forces, whereby, in the event of a difference between the desired force and the actual force, the distance of the guide body from a cloth-supporting plate is variable by an adjusting means in response to feedback from said logic device in such a way that a force corresponding to the preselected desired force is transmissible to the edge of the workpiece by way of the guide body and wherein said adjusting means comprises double-acting pressure medium cylinder whose movement is controllable by means of at least one solenoid valve and which movably carries the guide body.

5. A device as claimed in claim 1, wherein the adjusting means comprises a stepping motor in driving connection with guide body.

6. A device as claimed in claim 1, wherein for the purpose of controlling the sewing machine, a sensor is provided for detecting a leading end of the sewn hem approaching the needle.

7. A device as claimed in claim 1, wherein the at least one, preselectable, desired force is variable from a control panel disposed in the region of the sewing machine.

8. A device for the automatic formation and sewing of a hem at an edge of an opening in a workpiece, comprising:

hem-forming means having a needle and a needle plate;

guide body partially embraced by the workpiece;

means for detecting an actual force acting upon the guide body and thereby on the edge of the workpiece;

means for comparing the actual force with a preselected desired force from a range of forces; and means responsive to feedback from the comparing means for adjusting a location of the guide body relative to the needle plate such that the desired force is transmissible to the edge of the workpiece by the guide body.

9. The device of claim 8 wherein the guide body is disposed at a distance from the needle plate, and including means for moving the guide body relative to the needle plate to cause cloth tension.

10. The device of claim 9 wherein the detecting means comprises an actual value transducer.

11. The device of claim 10 wherein the actual value transducer comprises a travel sensor, with a prescribed force being associated with an effective length detected at the travel transducer.

12. The device of claim 8 wherein the guide body comprises a freely rotatably mounted wheel.

13. A device for the automatic formation and sewing of ahem at an edge of an opening in a workpiece, comprising:

hem-forming means having a needle and a needle plate;

a guide body partially embraced by the workpiece;

means for detecting an actual force acting upon the guide body and thereby on the edge of the workpiece;

means for comparing the actual force with a preselected desired force from a range of forces; and means responsive to feedback from the comparing means for adjusting a location of the guide body relative of the needle plate such that the desired force is transmissible to the edge of the workpiece by the guide body, wherein the adjusting means comprises a double-acting pressure medium cylinder whose movement is controllable by means of at least one solenoid valve and which movably carries the guide body.

14. The device of claim 8 wherein the adjusting means comprises a stepping motor in driving connection with the guide body.

15. The device of claim 8 including sensor means for detecting a leading end of the sewn hem approaching the needle.

* * * * *